US009903071B2

(12) United States Patent
Kominami

(10) Patent No.: US 9,903,071 B2
(45) Date of Patent: Feb. 27, 2018

(54) LOW FLAME-SPREADING CIGARETTE PAPER

(75) Inventor: Takashi Kominami, Yokohama (JP)

(73) Assignee: JAPAN TOBACCO INC., Tokyo (JP)

( * ) Notice: Subject to any disclaimer, the term of this patent is extended or adjusted under 35 U.S.C. 154(b) by 829 days.

(21) Appl. No.: 13/105,707

(22) Filed: May 11, 2011

(65) Prior Publication Data

US 2011/0209718 A1 Sep. 1, 2011

Related U.S. Application Data

(63) Continuation of application No. PCT/JP2009/068920, filed on Nov. 5, 2009.

(30) Foreign Application Priority Data

Nov. 12, 2008 (JP) ..... 2008-290135

(51) Int. Cl.
*A24D 1/02* (2006.01)
*D21H 19/10* (2006.01)
*D21H 27/00* (2006.01)

(52) U.S. Cl.
CPC ..... *D21H 19/10* (2013.01); *A24D 1/025* (2013.01); *D21H 27/00* (2013.01)

(58) Field of Classification Search
None
See application file for complete search history.

(56) References Cited

U.S. PATENT DOCUMENTS

| | | | | |
|---|---|---|---|---|
| 3,279,476 | A | 10/1966 | Noznick et al. | |
| 3,313,305 | A | 4/1967 | Noznick et al. | |
| 4,333,484 | A * | 6/1982 | Keritsis | 131/359 |
| 4,489,738 | A | 12/1984 | Simon | |
| 5,330,835 | A * | 7/1994 | Kikuchi et al. | 428/402.22 |
| 2003/0136420 | A1 | 7/2003 | Kraker | |
| 2008/0011312 | A1 | 1/2008 | Matsufuji et al. | |

FOREIGN PATENT DOCUMENTS

| | | | |
|---|---|---|---|
| AU | 461838 | | 4/1973 |
| CN | 101133214 | A | 2/2008 |
| EP | 0 870 437 | A2 | 10/1998 |
| EP | 1 723 860 | A1 | 11/2006 |
| EP | 1 867 782 | A1 | 12/2007 |
| JP | 2990166 | B1 | 12/1999 |
| JP | 2000-41648 | A | 2/2000 |
| JP | 2004-512849 | A | 4/2004 |
| JP | 2005-514939 | A | 5/2005 |
| RU | 2313264 | C2 | 12/2007 |

(Continued)

OTHER PUBLICATIONS

Applicant's Comments on Written Opinion.

(Continued)

*Primary Examiner* — Michael J Felton
(74) *Attorney, Agent, or Firm* — Birch, Stewart, Kolasch & Birch, LLP

(57) ABSTRACT

A cigarette paper exhibiting a low flame-spreading property comprises a base cigarette paper, and a plurality of burn-suppressing regions that are provided spaced apart from each other on one surface of the base cigarette paper. The burn-suppressing regions are formed by coating of a low-methoxyl pectin.

6 Claims, 1 Drawing Sheet

(56) References Cited

FOREIGN PATENT DOCUMENTS

| | | | |
|---|---|---|---|
| TW | 200529772 | A | 9/2005 |
| TW | 200708258 | A | 3/2007 |
| WO | WO 03/061410 | A1 | 7/2003 |
| WO | WO 2005/079609 | A1 | 9/2005 |
| WO | WO 2006/082529 | A2 | 8/2006 |
| WO | WO 2006/098153 | A1 | 9/2006 |
| WO | WO 2007/020532 | A1 | 2/2007 |

OTHER PUBLICATIONS

International Search Report dated Jan. 12, 2010 in PCT/JP2009/068920.
PCT/ISA/237 Written Opinion dated Jan. 12, 2010.
Chinese Office Action for Chinese Application No. 200980145001.2 dated Oct. 9, 2012 with partial English translation.
International Preliminary Report on Patentability and English translation of the Written Opinion of the International Searching Authority, dated Jun. 30, 2011, for corresponding International Application No. PCT/JP2009/068920.
Taiwanese Office Action of Taiwanese Application No. 098137541 dated Feb. 15, 2012 with English translation.
European Search Report dated Sep. 6, 2013 for Application No. 09 82 6056.
Canadian Office Action, dated May 5, 2017, for Canadian Application No. 2,742,669.
"Pectin", from Wikipedia, downloaded Jun. 1, 2015.
Decision of Reexamination dated Jul. 23, 2015 of Chinese Patent Application No. 200980145001.2 with English Translation.
Wang et al. (eds.), Food Chemistry, China Light Industry Press, Sep. 1999, pp. 74-76.
Russian Office Action, dated Apr. 18, 2012, for Russian Application No. 2011118875, including English translation.
Office Action dated Sep. 29, 2016, in Chinese Patent Application No. 201510695463.9, with English translation.
Office Action dated Aug. 19, 2016, in Canadian Patent Application No. 2,742,669.
Canadian Search Report dated Nov. 16, 2015 for Application No. 2,742,669.

* cited by examiner

LOW FLAME-SPREADING CIGARETTE PAPER

CROSS REFERENCE TO RELATED APPLICATIONS

This is a Continuation Application of PCT Application No. PCT/JP2009/068920, filed Nov. 5, 2009, which was published under PCT Article 21(2) in Japanese.

This application is based upon and claims the benefit of priority from prior Japanese Patent Application No. 2008-290135, filed Nov. 12, 2008, the entire contents of which are incorporated herein by reference.

BACKGROUND OF THE INVENTION

1. Field of the Invention

The present invention relates to a low flame-spreading cigarette paper.

2. Description of the Related Art

A smoking cigarette is required to continue to burn in an ordinary smoking state, while it is desirable to hardly cause the flame to spread from the kindling to a floor or the like when the cigarette falls on the floor or the like because of, for example, carelessness of a smoker. Under such circumstances, for example, Jpn. PCT National Publication No. 2004-512849 proposes a cigarette paper that has a function to prevent the spread of flame when a burning cigarette falls down, by applying a film-forming composition in the shape of bands on a wrapping paper to decrease the air permeability of the wrapping paper on the applied region. As the film forming composition, alginate, pectin, silicate, carboxylmethyl cellulose, other cellulose derivatives, guar gum, starch, modified starch, polyvinyl acetate, polyvinyl alcohol and the like are exemplified therein.

BRIEF SUMMARY OF THE INVENTION

However, Jpn. PCT National Publication No. 2004-512849 dose not provide a measurement example of the flame-spreading property of the wrapping paper on which the film-forming composition has been applied.

On the other hand, the present inventors have coated a wrapping paper with pectin from among various substances and studied on the actual flame-spreading property of the wrapping paper, and found that the flame-spreading performances vary depending on the difference in the degree of esterification (DE) value of the coated pectin, when compared under the condition of the same coating amount.

Therefore, it is an object of the present invention to provide a cigarette paper that exhibits a good flame-spreading suppression effect by a small coating amount of pectin.

According to the present invention, there is provided a cigarette paper exhibiting a low flame-spreading property, characterized by comprising a base cigarette paper, and a plurality of burn-suppressing regions that are provided spaced apart from each other on one surface of the base cigarette paper, wherein the burn-suppressing regions are formed by coating the base cigarette paper with a low-methoxyl pectin.

According to one embodiment of the present invention, the cigarette paper provides a cigarette that exhibits a PFLB value of 0 to 25%, when measured according to ASTM E-2187-04.

According to another embodiment of the present invention, the base cigarette paper has a basis weight of 15 to 30 g/m$^2$.

According to another embodiment of the present invention, the coated portion is coated with the low-methoxyl pectin in an amount of 2.0 g or less per m$^2$ of area of the coated portion.

According to another embodiment of the present invention, the burn-suppressing regions are in a form of a plurality of stripes such that when a tobacco rod is wrapped with the cigarette paper, they extend in a longitudinal direction of the tobacco rod and are spaced apart from each other in a circumferential direction of the tobacco rod.

According to another embodiment of the present invention, the burn-suppressing regions are in a form of a plurality of annular bands such that when a tobacco rod is wrapped with the cigarette paper, they extend in a circumferential direction of the tobacco rod and are spaced apart from each other in a longitudinal direction of the tobacco rod.

According to the present invention, a base cigarette paper is coated with low-methoxyl (LM) pectin as a burn-suppressing agent, thereby providing a low flame-spreading cigarette paper that exhibits a good flame-spreading suppression effect by a small coating amount.

DETAILED DESCRIPTION OF THE INVENTION

Figure 1:
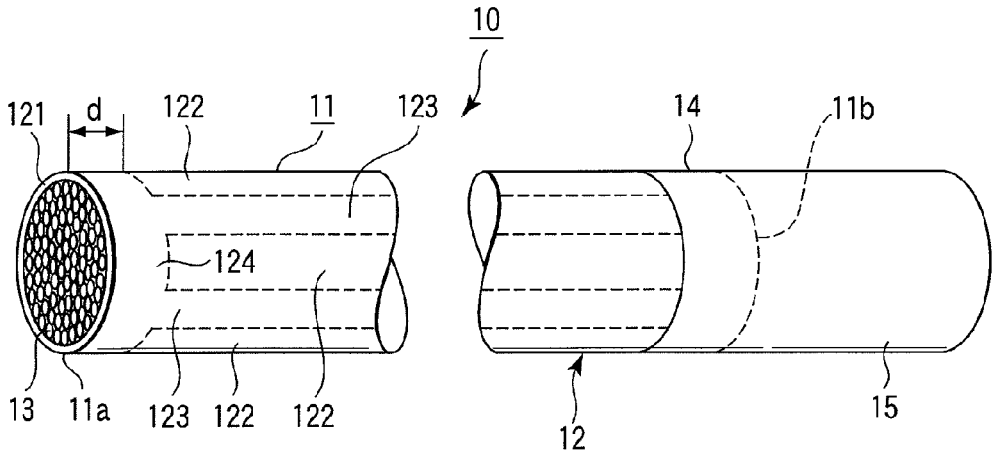
FIG. 1 is a schematic perspective view, partly broken away, showing an example of a cigarette that is wrapped with a cigarette paper according to one embodiment of the present invention.

The present invention will now be described in more detail.

In the cigarette paper of the present invention, a plurality of burn-suppressing regions, which are coated with a burn-suppressing agent comprising LM pectin, are formed apart from each other on a wrapping paper as a base (base cigarette paper).

The base cigarette paper is an ordinary cigarette paper which is based on ordinary flax pulp. Such base cigarette paper generally contains a commonly-used filler including carbonates such as calcium carbonate and hydroxides such as calcium hydroxide and magnesium hydroxide in an amount of 2 g/m$^2$ or more. The filler may be contained in the base cigarette paper in an amount of 2 to 8 g/m$^2$. Furthermore, the base cigarette paper generally has a basis weight of 15 to 30 g/m$^2$. The basis weight is preferably from 20 to 28 g/m$^2$. The base cigarette paper generally has an inherent air permeability of 10 to 80 CORESTA units.

A burn adjusting agent such as citric acid or a salt thereof (a sodium salt or a potassium salt) may be added to the base cigarette paper. Generally, the burn adjusting agent is used in an amount of 2% by weight or less in the base cigarette paper, if added.

On the surface of the base cigarette paper, a plurality of burn-suppressing regions, which are each formed by coating of a burn-suppressing agent (LM pectin), are provided apart from each other. The burn-suppressing regions may be provided in the forms of a plurality of stripes such that when a tobacco rod is wrapped with the cigarette paper, they extend in the longitudinal direction of the tobacco rod and are spaced apart from each other in the circumferential direction of the tobacco rod. Alternatively, the burn-suppressing regions may be provided in the forms of a plurality of annular bands such that they extend in the circumferential direction of the tobacco rod and are spaced apart from each other in the longitudinal direction of the tobacco rod.

In the present invention, LM pectin is used as the burn-suppressing agent. Pectin generally consists of a polysaccharide (pectic acid) composed of α-D-galacturonic acid, and pectinic acid in which a part of pectic acid has been methylesterified. The ratio of pectinic acid in total pectin is referred to as the degree of esterification (DE). Pectin having a DE of 50% or more is referred to as a HM (high-methoxyl) pectin, and pectin having a DE value of lower than 50% is referred to as a LM (low-methoxyl) pectin.

Pectin is bound to cellulose and the like in a plant tissue and present as a water-insoluble component. Most of pectin extracted with an acidic solution is HM pectin, and if LM pectin is to be prepared, the site on the C-6 position of galacturonic acid is demethylated by using an acid, an alkali, an enzyme or ammonia. LM pectins having various DEs corresponding to the degrees of demethylation are commercially available.

Furthermore, although both HM and LM pectins have gelation capacity, their gelation mechanisms are different from each other. Specifically, the HM pectin forms a heat irreversible gel at about 55% or more of a saccharide and a pH of 3.5 or less, whereas the LM pectin gelates in the presence of polyvalent metal ion such as calcium and magnesium irrespective of the saccharide, pH and the amount of the solid content. The gelation mechanism of the LM pectin is considered to be due to an ionic bond by which polyvalent metal ion (for example, $Ca^{2+}$) forms crosslinking between the carboxyl groups in a pectin molecule, and to a coordinate bond between a lone electron pair and polyvalent metal ion.

In the present invention, the LM pectin can be applied to a base cigarette paper, for example, by a gravure printing process, in the form of a relatively high concentration of aqueous solution (a concentration from 1 to 12% by weight). Since the aqueous solution of the LM pectin is acidic, the solution can dissolve calcium carbonate, calcium hydroxide and magnesium hydroxide, which are hardly water-soluble fillers contained in the base cigarette paper, thereby dissociating polyvalent cations (calcium ion and magnesium ion). The dissociated polyvalent cations convert LM pectin into a gel by the above-mentioned gelation mechanism, whereby a strong LM pectin gel is formed. This enables the formation of a coating even by a relatively small amount of LM pectin. The above-mentioned amount of the filler in the base cigarette paper is sufficient for such gelation of LM pectin.

By coating the cigarette paper of the present invention with the above-mentioned LM pectin, the present invention can provide a cigarette (a cigarette obtained by wrapping a tobacco filler with the cigarette paper) that exhibits the value of PFLB (percent full-length burn) of 0 to 25%, preferably 0 to 5%, when measured according to ASTM E-2187-04. Generally, the coating amount (dry basis) of the LM pectin is preferably 2 g or less per $m^2$ of area of the coated portion.

The LM pectin can achieve a PFLB value of approximately 15% or less by a coating amount of 1.2 to 2.0 $g/m^2$.

The present invention will now be described in more detail with reference to FIGS. 1 and 2.

FIG. 1 is a schematic perspective view, partly broken away, showing an example of a cigarette that is wrapped with a cigarette paper having stripe-shaped burn-suppressing regions according to one embodiment of the present invention. FIG. 2 is a schematic perspective view, partly broken away, showing an example of a cigarette that is wrapped with a cigarette paper having annular band-shaped burn-suppressing regions according to another embodiment of the present invention.

Referring to FIG. 1, a cigarette 10 has a tobacco rod 11 consisting of a tobacco filler 13 that is wrapped with a cigarette paper 12 of the present invention in the form of a column. The tobacco rod 11 generally has a circumference of 17 to 26 mm and a length of 49 to 90 mm. A ordinary filter 15 may be attached to the proximal end (namely, the downstream end in the inhaling direction) 11*b* of the tobacco rod 11 by using a tipping paper 14 according to a conventional method.

A plurality of stripe-shaped regions 122, which are coated with the burn-suppressing agent (LM pectin) as explained above, are formed on the inner surface of the base cigarette paper 121 (the surface contacting with the tobacco filler) that constitutes the cigarette paper 12 of the present invention, defining burn-suppressing regions. These stripe-shaped burn-suppressing regions 122 are formed apart from each other in the circumferential direction of the tobacco rod 11.

Ordinary burn regions 123, which are not coated with the burn-suppressing agent, are formed between the adjacent stripe-shaped burn-suppressing regions 122. Since the regions 123 are constituted by a part of the base cigarette paper 121, they can burn in an ordinary smoking state, as in the base cigarette paper 121 itself. Therefore, the regions 123 each act as an ordinary burn region. For example, the stripe-shaped burn-suppressing regions 122 each may have a width of 1 to 6 mm in the circumferential direction. The distance between the adjacent burn-suppressing regions 122 is preferably 2 to 20 mm.

In the cigarette shown in FIG. 1, a region 124 which is not coated with the burn-suppressing agent may be provided to the region covering a distance d from the tip of the base cigarette paper 121. The region at the tip portion, which is not coated with the burn-suppressing agent, also constitutes an ordinary burn region, and may correspond to the region that is combusted by one puff or two puffs in an ordinary cigarette. The distance d from the tip 11*a* of the tobacco rod may be 10 to 25 mm. It is not particularly necessary to form a burn-suppressing region 122 on the inner surface of the cigarette paper corresponding to that portion of the cigarette paper 121 which is covered with the tipping paper 14.

Figure 2:
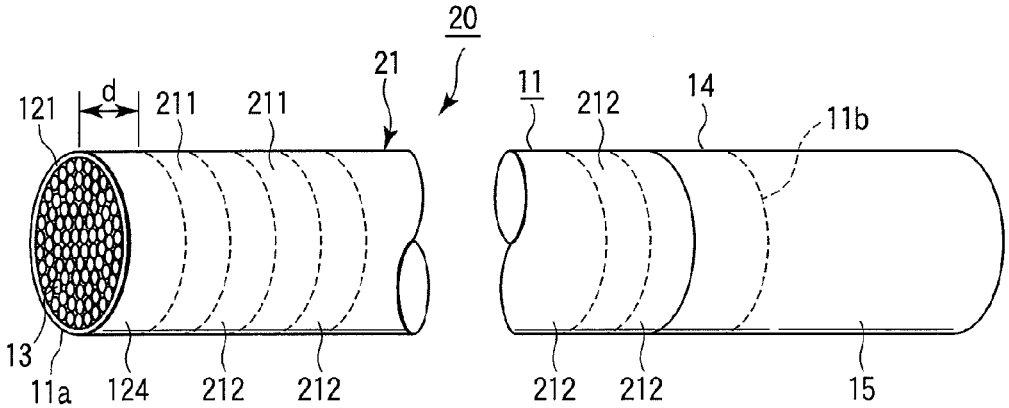
FIG. 2 is a schematic perspective view, partly broken away, showing an example of a cigarette that is wrapped with a cigarette paper according to another embodiment of the present invention.

A cigarette 20 shown in FIG. 2 has a similar structure to that of the cigarette 10 shown in FIG. 1, except for the structure of the burn-suppressing regions in the cigarette paper wrapping the tobacco filler. Therefore, in FIG. 2, an identical reference number is assigned to the same element as the constitutional element in FIG. 1, and the explanation thereof is omitted.

In the cigarette 20 shown in FIG. 2, a plurality of annular band-shaped regions 211, which are coated with the burn-suppressing agent (LM pectin) as explained above, are formed on the base cigarette paper 121 of the cigarette paper 21 wrapping the tobacco filler 13, defining burn-suppressing regions. These annular band-shaped burn-suppressing regions 211 are formed apart from each other in the longitudinal direction of the tobacco rod 11.

Ordinary burn regions 212, which are not coated with the burn-suppressing agent, are formed between the adjacent annular band-shaped burn-suppressing regions 211. Since the regions 212 are constituted by a part of the base cigarette paper 121, they can burn in an ordinary smoking state, as in the base cigarette paper 121 itself. Therefore, the regions 212 each act as an ordinary burn region, as in the regions 123 in FIG. 1 does. For example, the annular band-shaped burn-suppressing regions 211 each may have a width of 4 to 7 mm in the longitudinal direction. The distance between the adjacent burn-suppressing regions 24 is preferably 18 to 25 mm.

When the cigarette 10 or 20 is ignited at the tip 11*a* and inhaled to be burnt, the cigarette can burn at the ordinary burn regions 123 or 212 as in an ordinary cigarette, and flavor and taste can be enjoyed. However, if the ignited cigarette 10 or 20 is put on a combustible material such as a carpet, a tatami mat, a wooden article, a cloth or clothing, a combination of the burn-suppressing regions 122 or 211 and the heat absorption by the combustible material serve to extinguish the cigarette 10 or 20, and prevent the combustible material from catching fire.

EXAMPLES

The present invention will be described by way of Examples below, but the present invention is not limited by these Examples.

Examples and Comparative Examples

The pectins used in the Examples and Comparative Examples are products from CP Kelco whose DE values have been defined respectively. The product names and DE values of these pectins are shown in Table 1.

TABLE 1

| | Name of commercial product | DE value [%] |
|---|---|---|
| Pectin | LM-5CSJ | 6-12 |
| | LM-106AS-YA-J | 23 |
| | LM-13CG-J | 38 |
| | AS Confectionary-J | 52 |
| | DD Slow Set J | 63-67 |
| | BB Rapid Set J | 70-75 |

Next, the base cigarette papers having the specifications as shown in Tables 2 to 4 (all had a width of 27 mm, a length of 1.500 m; filler: calcium carbonate, burn adjusting agent: sodium citrate) were coated (printed) with 3 to 6% by weight of an aqueous pectin solution in the forms of stripes at a constant width of 7 mm in the longitudinal direction and a constant spacing of 20 mm by a direct gravure process, forming the pectin-coated regions. For the cigarette papers thus obtained, the total coating amount of pectin was measured according to the following process.

<Method for Determining the Quantity of Pectin>

The measurement is based on that galacturonic acid that constitutes pectin and carbazole give a red-purple color by heating an extracted pectin solution together with concentrated sulfuric acid and thereafter adding carbazole.

The measurement was performed in accordance with the carbazole colorimetric method described in "Shin Shokuhin Bunseki Hou (New Food Analysis Method)" (pages 232 to 235). A cigarette paper coated with pectin was cut into pieces each having a size of a length of 0.8 m and a width of 27 mm (about 0.5 g), and these were further cut finely into pieces having size of 5 mm square. The finely cut cigarette paper was put into 30 mL of an aqueous sodium hexametaphosphate solution having a concentration of 4% by weight, heated for 30 minutes in a hot water bath at 70° C., and then the supernatant liquid was obtained by such extraction operation. The similar extraction operation was repeated three times for the extraction residue, and the supernatant liquid was obtained in a similar manner. All of the supernatant liquids thus obtained were combined, and a solvent (an aqueous sodium hexametaphosphate solution having a concentration of 4% by weight) was added to adjust the total volume to 100 mL, and this was used as a test solution. 3 mL of concentrated sulfuric acid was added to each of 1 mL of a pectin standard solution and 1 mL of the test solution, and the mixture was heated at 100° C. for 10 minutes under reflux. The reaction product was cooled in running water, 0.25 mL of a solution of carbazole in ethanol having a concentration of 0.05% by weight was added thereto, and a color reaction was performed for 1.5 hours under room temperature. The solution was subjected to a colorimetric determination at 520 nm, and the total coating amount of pectin was calculated. The value of the total coating amount was divided by the area of the cigarette paper to calculate the coating amount of pectin per $m^2$ of area of the cigarette paper used in the measurement. Since the cigarette paper has a width of 27 mm and the region coated with pectin has a width of 7 mm, the calculated value of the coating amount of pectin per $m^2$ of area of the cigarette paper was multiplied by 27/7 to give the value of the coating amount of pectin per $m^2$ of area of the region coated with pectin.

<Burn Test>

A tobacco rod consisting of American-blend of tobacco shreds was wrapped with the cigarette paper obtained above, and cut such that the first coated region was arranged 5 mm spaced apart from the burn edge of the cigarette. Each cigarette had a cigarette length of 59 mm and two pectin-coated regions. The cigarette thus obtained was subjected to a burn test in accordance with ASTM E-2187-04 to measure the value of PFLB (percent full-length burn).

The relationships between the DE value of pectin and the PFLB value in the cases where the coating amount of pectin per $m^2$ of area of the region coated with pectin were 1.5, 2.0 and 2.5 g, respectively, are shown in Tables 2, 3 and 4, respectively.

TABLE 2

Example: Cases where 1.5 g/$m^2$ of coating amount was used

| | DE value of pectin used [%] | Specification of base cigarette paper: Basis weight [g/$m^2$] | Amount of filler [g/$m^2$] | Air permeability [C.U.] | PFLB [%] |
|---|---|---|---|---|---|
| Example 1-1 | 6-12 | 24 | 7.8 | 35 | 0 |
| Example 1-2 | 23 | 24 | 7.8 | 35 | 8 |
| Example 1-3 | 38 | 24 | 7.8 | 35 | 12 |
| Comparative Example 1-1 | 52 | 24 | 7.8 | 35 | 49 |
| Comparative Example 1-2 | 63-67 | 24 | 7.8 | 35 | 78 |
| Comparative Example 1-3 | 70-75 | 24 | 7.8 | 35 | 88 |

TABLE 3

Example 2: Cases where 2.0 g/$m^2$ of coating amount was used

| | DE value of pectin used [%] | Specification of base cigarette paper: Basis weight [g/$m^2$] | Amount of filler [g/$m^2$] | Air permeability [C.U.] | PFLB [%] |
|---|---|---|---|---|---|
| Example 2-1 | 6-12 | 24 | 7.8 | 35 | 0 |
| Example 2-2 | 23 | 24 | 7.8 | 35 | 0 |
| Example 2-3 | 38 | 24 | 7.8 | 35 | 0 |

TABLE 3-continued

| Example 2: Cases where 2.0 g/m$^2$ of coating amount was used | | | | | |
|---|---|---|---|---|---|
| | DE value | Specification of base cigarette paper | | | |
| | of pectin used [%] | Basis weight [g/m$^2$] | Amount of filler [g/m$^2$] | Air permeability [C.U.] | PFLB [%] |
| Comparative Example 2-1 | 52 | 24 | 7.8 | 35 | 8 |
| Comparative Example 2-2 | 63-67 | 24 | 7.8 | 35 | 25 |
| Comparative Example 2-3 | 70-75 | 24 | 7.8 | 35 | 72 |

TABLE 4

| Example 3: Cases where 2.5 g/m$^2$ of coating amount was used | | | | | |
|---|---|---|---|---|---|
| | DE value | Specification of base cigarette paper | | | |
| | of pectin used [%] | Basis weight [g/m$^2$] | Amount of filler [g/m$^2$] | Air permeability [C.U.] | PFLB [%] |
| Example 3-1 | 6-12 | 24 | 7.8 | 35 | 0 |
| Example 3-2 | 23 | 24 | 7.8 | 35 | 0 |
| Example 3-3 | 38 | 24 | 7.8 | 35 | 0 |
| Comparative Example 3-1 | 52 | 24 | 7.8 | 35 | 0 |
| Comparative Example 3-2 | 63-67 | 24 | 7.8 | 35 | 0 |
| Comparative Example 3-3 | 70-75 | 24 | 7.8 | 35 | 28 |

Furthermore, the relationships between the minimum coating amount of the burn-suppressing agent (pectin) that is required to achieve PFLB values of 0% and 25% and the DE values of pectin are shown in Tables 5 and 6, respectively.

TABLE 5

| Minimum coating amount required for PFLB of 0% | |
|---|---|
| DE value [%] | Minimum coating amount for Burn-suppressing region [g/m$^2$] |
| 6-12 | 1.5 |
| 23 | 1.8 |
| 38 | 1.7 |
| 52 | 2.4 |
| 63-67 | 2.3 |
| 70-75 | 2.7 |

TABLE 6

| Minimum coating amount required for PFLB of 25% | |
|---|---|
| DE value [%] | Minimum coating amount for Burn-suppressing region [g/m$^2$] |
| 6-12 | 1.3 |
| 23 | 1.5 |
| 38 | 1.3 |
| 52 | 1.7 |
| 63-67 | 2.0 |
| 70-75 | 2.5 |

As is apparent from Tables 2 to 4, when a comparison was made between the cases of the same coating amount, a lower PFLB value could be obtained in the case where LM pectin was used, as compared to the case where HM pectin was used. Specifically, when the coating amount was 1.5 g/m$^2$, good PFLB values of 12% or less were obtained in Example 1-1, Example 1-2 and Example 1-3 in which LM pectin was used, whereas PFLB values of 49% or more were obtained in Comparative Example 1-1, Comparative Example 1-2 and Comparative Example 1-3 in which HM pectin was used (Table 2). Furthermore, when the coating amount was 2.0 g/m$^2$, PFLB values of 0% were obtained in all of Example 2-1, Example 2-2 and Example 2-3 in which LM pectin was used (Table 3). However, when the coating amount was 2.5 g/m$^2$, no significant difference in the PFLB value was observed between the case of HM pectin and the case of LM pectin, because the coating amount of pectin itself was large (Table 4).

On the other hand, it was found that, in order to obtain the same PFLB value, the coating amount could be kept lower in the case of LM pectin than that of HM pectin (Tables 5 and 6). Specifically, in order to obtain a PFLB value of 0%, the minimum coating amount of 1.5 to 1.7 g/m$^2$ was required in the case where LM pectin was used, whereas the minimum coating amount of 2.3 to 2.7 g/m$^2$ was required in the case of HM pectin. Furthermore, in order to obtain a PFLB value of 25%, the minimum coating amount of 1.3 to 1.5 g/m$^2$ was required in the case where LM pectin was used, whereas the minimum coating amount of 1.7 to 2.5 g/m$^2$ was required in the case of HM pectin.

DESCRIPTION OF REFERENCE NUMBERS

10, 20 . . . cigarette
11 . . . tobacco rod
11*a*, 21*a* . . . tip of tobacco rod
11*b*, 21*b* . . . proximal end of tobacco rod
12, 21 . . . cigarette paper
121 . . . base cigarette paper
122, 211 . . . burn-suppressing region
123, 212 . . . ordinary burn region
124 . . . ordinary burn region at tip portion
13 . . . tobacco filler
14 . . . tipping paper
15 . . . filter

What is claimed is:

1. A cigarette paper exhibiting a low flame-spreading property, comprising: a base cigarette paper; and a plurality of burn-suppressing regions that are provided spaced apart from each other on one surface of the base cigarette paper, wherein said burn-suppressing regions are formed by coating the base cigarette paper with a low-methoxyl pectin having a degree of esterification lower than 50%, wherein the amount of said pectin in the pectin-coated burn-suppressing regions is 1.2 to 2.0 grams per square meter.

2. The cigarette paper according to claim 1, which provides a cigarette that exhibits a PFLB value of 0 to 25%, when measured according to ASTM E-2187-04.

3. The cigarette paper according to claim 1, wherein the base cigarette paper has a basis weight of 15 to 30 g/m$^2$.

4. The cigarette paper according to claim 1, wherein the bum-suppressing regions are in a form of a plurality of stripes such that when a tobacco rod is wrapped with the cigarette paper, they extend in a longitudinal direction of the tobacco rod and are spaced apart from each other in a circumferential direction of the tobacco rod.

5. The cigarette paper according to claim 1, wherein the bum-suppressing regions are in a form of a plurality of annular bands such that when a tobacco rod is wrapped with the cigarette paper, they extend in a circumferential direction of the tobacco rod and are spaced apart from each other in a longitudinal direction of the tobacco rod.

6. The cigarette paper according to claim 1, wherein the burn-suppressing regions are formed by coating the base cigarette paper with an aqueous solution containing only a low-methoxyl pectin having a degree of esterification lower than 50% as a gel forming agent.

* * * * *